US008482375B2

(12) United States Patent
Felmetsger

(10) Patent No.: US 8,482,375 B2
(45) Date of Patent: Jul. 9, 2013

(54) SPUTTER DEPOSITION OF CERMET RESISTOR FILMS WITH LOW TEMPERATURE COEFFICIENT OF RESISTANCE

(75) Inventor: Valery V. Felmetsger, Goleta, CA (US)

(73) Assignee: OEM Group, Inc., Gilbert, AZ (US)

( * ) Notice: Subject to any disclaimer, the term of this patent is extended or adjusted under 35 U.S.C. 154(b) by 271 days.

(21) Appl. No.: 12/786,238

(22) Filed: May 24, 2010

(65) Prior Publication Data

US 2010/0301989 A1 Dec. 2, 2010

Related U.S. Application Data

(60) Provisional application No. 61/180,884, filed on May 24, 2009.

(51) Int. Cl.
*H01C 1/012* (2006.01)

(52) U.S. Cl.
USPC ..... 338/308

(58) Field of Classification Search
USPC ..... 338/308
See application file for complete search history.

(56) References Cited

U.S. PATENT DOCUMENTS

| | | | | |
|---|---|---|---|---|
| 3,650,940 | A | 3/1972 | Bardahl | |
| 3,856,647 | A | 12/1974 | Balchman | |
| 3,879,278 | A * | 4/1975 | Grosewald et al. | 204/192.15 |
| 4,007,063 | A | 2/1977 | Yasuda et al. | |
| 4,010,312 | A | 3/1977 | Pinch et al. | |
| 4,298,804 | A | 11/1981 | Colditz | |
| 4,404,077 | A | 9/1983 | Fournier | |
| 4,427,524 | A | 1/1984 | Crombeen et al. | |
| 4,486,287 | A | 12/1984 | Fournier | |
| 4,547,279 | A | 10/1985 | Kiyota et al. | |
| 4,572,776 | A | 2/1986 | Aichert et al. | |
| 4,595,482 | A | 6/1986 | Mintz | |
| 4,619,865 | A | 10/1986 | Keem et al. | |
| 4,661,228 | A | 4/1987 | Mintz | |
| 4,923,584 | A | 5/1990 | Bramhall, Jr. et al. | |

(Continued)

FOREIGN PATENT DOCUMENTS

| | | |
|---|---|---|
| DE | 4127262 C1 | 6/1992 |
| EP | 0010971 | 5/1980 |

(Continued)

OTHER PUBLICATIONS

Alami et al., "Ion-Assisted Physical Vapor Deposition for Enhanced Film Properties on Nonflat Surfaces", J. Vac. Sci. Technol. A 23(2), Mar./Apr. 2005, 278-280.

(Continued)

*Primary Examiner* — Kyung Lee
(74) *Attorney, Agent, or Firm* — Ari M. Bai; Polsinelli PC

(57) ABSTRACT

A solution for producing nanoscale thickness resistor films with sheet resistances above 1000Ω/□ (ohm per square) and low temperature coefficients of resistance (TCR) from −50 ppm/° C. to near zero is disclosed. In a preferred embodiment, a silicon-chromium based compound material (cermet) is sputter deposited onto a substrate at elevated temperature with applied rf substrate bias. The substrate is then exposed to a process including exposure to a first in-situ anneal under vacuum, followed by exposure to air, and followed then by exposure to a second anneal under vacuum. This approach results in films that have thermally stable resistance properties and desirable TCR characteristics.

20 Claims, 8 Drawing Sheets

U.S. PATENT DOCUMENTS

| | | | | |
|---|---|---|---|---|
| 4,946,546 | A | | 8/1990 | Bourgeoi-Moine |
| 4,946,576 | A | | 8/1990 | Dietrich et al. |
| 5,096,536 | A | | 3/1992 | Cathey |
| 5,133,850 | A | | 7/1992 | Kukla et al. |
| 5,174,880 | A | | 12/1992 | Bourez et al. |
| 5,266,178 | A | | 11/1993 | Sichmann |
| 5,345,534 | A | | 9/1994 | Najm et al. |
| 5,415,757 | A | | 5/1995 | Szcyrbowski et al. |
| 5,507,930 | A | | 4/1996 | Yamashita et al. |
| 5,558,749 | A | | 9/1996 | Yokoyama et al. |
| 5,597,459 | A | | 1/1997 | Altshuler |
| 5,879,519 | A | | 3/1999 | Seeser et al. |
| 5,882,399 | A | | 3/1999 | Ngan et al. |
| 5,897,753 | A | | 4/1999 | Schatz et al. |
| 5,925,225 | A | | 7/1999 | Ngan et al. |
| 6,081,014 | A | | 6/2000 | Redford et al. |
| 6,130,170 | A | | 10/2000 | David et al. |
| 6,154,119 | A | * | 11/2000 | Jankowski et al. ..... 338/308 |
| 6,171,922 | B1 | | 1/2001 | Maghsoudnia |
| 6,294,444 | B1 | | 9/2001 | Ueno |
| 6,342,448 | B1 | | 1/2002 | Lin et al. |
| 6,352,627 | B2 | | 3/2002 | Leyendecker et al. |
| 6,375,810 | B2 | | 4/2002 | Hong |
| 6,399,411 | B1 | | 6/2002 | Hori et al. |
| 6,420,863 | B1 | | 7/2002 | Milde et al. |
| 6,482,681 | B1 | | 11/2002 | Francis et al. |
| 6,488,823 | B1 | | 12/2002 | Chiang et al. |
| 6,720,261 | B1 | | 4/2004 | Anderson et al. |
| 6,806,173 | B1 | | 10/2004 | Spitz et al. |
| 6,824,653 | B2 | | 11/2004 | Oshmyansky et al. |
| 6,863,987 | B2 | | 3/2005 | Kaneko et al. |
| 7,179,350 | B2 | | 2/2007 | Laptev et al. |
| 2002/0075131 | A1 | | 6/2002 | Coates et al. |
| 2002/0093101 | A1 | | 7/2002 | Iyer et al. |
| 2003/0017628 | A1 | | 1/2003 | Li et al. |
| 2003/0068898 | A1 | | 4/2003 | Lee et al. |
| 2003/0109198 | A1 | | 6/2003 | Lee et al. |
| 2003/0132524 | A1 | | 7/2003 | Felmetsger |
| 2003/0205460 | A1 | | 11/2003 | Buda |
| 2004/0163952 | A1 | | 8/2004 | Oshmyansky et al. |
| 2004/0168637 | A1 | | 9/2004 | Gorokhovsky |
| 2004/0231972 | A1 | | 11/2004 | Laptev et al. |
| 2004/0253828 | A1 | | 12/2004 | Ozawa et al. |
| 2007/0046927 | A1 | | 3/2007 | Le et al. |
| 2007/0080611 | A1 | | 4/2007 | Yamada et al. |
| 2007/0235810 | A1 | | 10/2007 | Delgado et al. |
| 2008/0083611 | A1 | | 4/2008 | Felmetsger |
| 2009/0242388 | A1 | | 10/2009 | Laptev et al. |
| 2009/0242392 | A1 | | 10/2009 | Laptev et al. |
| 2009/0246385 | A1 | | 10/2009 | Felmetsger et al. |

FOREIGN PATENT DOCUMENTS

| | | | |
|---|---|---|---|
| EP | 0227438 | | 1/1987 |
| EP | 0334564 | A | 9/1989 |
| EP | 1046727 | A | 10/2000 |
| EP | 1306896 | A1 | 5/2003 |
| GB | 2106714 | A | 4/1983 |
| JP | 63-317671 | | 12/1988 |
| JP | 01-116068 | | 5/1989 |
| JP | 02-225662 | | 9/1990 |
| JP | 11-307479 | | 11/1999 |
| JP | 2001-003166 | | 1/2001 |
| JP | 2002033325 | A | 1/2002 |
| RU | 2135634 | | 8/1999 |
| WO | WO 01/29278 | A | 4/2001 |
| WO | WO 0184619 | A2 | 11/2001 |
| WO | WO 2004/107411 | | 12/2004 |

OTHER PUBLICATIONS

Beach, "Design of Low-Temperature Thermal Chemical Vapor Deposition Processes", IBM J. REs. Develop., Nov. 1990, vol. 34, No. 6.

Blachman, "Stress and Resistivity Control in Sputtered Molybdenum Films and Comparison with Sputtered Gold", Metallurgical Transactions, 2, 1971, 699-709.

Chiu et al., "The Control of Film Stress Using Ionised Magnetron Sputter Deposition", Thin Solid Films, 343-344-(1999) 39-42.

Dubois et al, "Stress and Piezoelectric Properties of Aluminum Snitide Thin Films Deposited onto Metal Electrodes by Pulsed Direct Current Reactive Sputtering", Journal of Applied Physics, vol. 89, No. 11, 6389-6395.

Este et al., "Stress Control in Reactively Sputtered AlN and TiN Films", J. Vac. Sci. Technol. A5 (4), Jul./Aug. 1987, 1892-1897.

Felmetsger, "Stress Control in Multi-Layer Backside Metallization on Thinned Wafers", Oct. 1999, Sputtered Films, Inc., pp. 1-15.

Felmetsger, "Tailoring Sputtered Cr Films on Large Wafers", 1999, Sputtered Films, Inc., pp. 1-8.

Iriarte et al, "Influence of Deposition Parameters on the Stress of Magnetron Sputter-Deposited AlN Thin Films on Si(100) Substrates", J. Mater. Res., vol. 18, No. 2, 2003, 423-432.

Ko et al., "Microstructure Analyses of the Titanium Films Formed by the Ionized Sputtering Process", Thin Solid Films 340, (1999), 13-17.

Naik et al, "Low Temperature Deposition of Highly Textured AlN Film by Direct Current Magnetron Sputtering for Application in Thin Film Resonators", J. Electrochem. Soc., 146, 691-696, 1999.

Oshmyansky et al, "Sputtering Process for Bulk Acoustic Wave Filters", Semiconductor Int., Mar. 2003.

International Preliminary Report on Patentability for international application No. PCT/US2007/080237, dated Apr. 7, 2009.

Thornton, "The Microstructure of Sputter-Deposited Coatings", J. Vac. Sci. Technol. A4 (6), Nov./Dec. 1986, 3059-3065.

Windischmann, "Intrinsic Stress in Sputter-Deposited Thin Films", Critical Reviews in Solid State and Materials Sciences, 17:6, 547-596., 1992.

Winidschmann, "Intrinsic Strerss in Sputtered Thin Films", J. Vac. Sci. Technol. A9 (4), Jul./Aug. 1991, 2431-2436.

Felmetsger, "High-adhesive back side metallization of ultrathin wafers." J. Vac. Sci. Technology B 25(3), May/Jun. 2007, 881-885.

Felmetsger, "Design, operation mode, and stress control capability of S-Gun magnetron for AC reactive sputtering." Surface & Coating Technology 204 (2009) 840-844, 840-844.

Lundqvist N., Aberg J., Nygren S., Bjormander C, Zhang S. Effects fo substrate bias and temperature during titanium sputter-depostion on the phase formation in TiSi2. Microelectronics Engineering 60 (2002) 211-220.

Sricharoenchai P, Panich N, Visuttipitukul P, Wangyao. Effect of Substrate Temperature, Biasing and Sputter Cleaning on the Structure and Properties of Nanostructured TiB2 Coatings on High Speed Steel. Materials Transactions, vol. 51, No. 2 (2010), 246-252.

Non-Final Office Action for U.S. Appl. No. 11/863,046 dated Sep. 24, 2010.

Final Office Action for U.S. Appl. No. 11/863,046 dated Mar. 10, 2011.

Non-Final Office Action for U.S. Appl. No. 11/863,046 dated Nov. 4, 2011.

Final Office Action for U.S. Appl. No. 11/863,046 dated Apr. 6, 2012.

Non-Final Office Action for U.S. Appl. No. 11/863,046 dated Oct. 11, 2012.

Non-Final Office Action for U.S. Appl. No. 12/411,369 dated Nov. 4, 2011.

Final Office Action for U.S. Appl. No. 12/411,369 dated Mar. 14, 2012.

Non-Final Office Action for U.S. Appl. No. 12/411,369 dated Jul. 19, 2012.

Non-Final Office Action for U.S. Appl. No. 12/411,301 dated Oct. 27, 2011.

Final Office Action for U.S. Appl. No. 12/411,301 dated Apr. 24, 2012.

Non-Final Office Action for U.S. Appl. No. 12/411,301 dated Dec. 11, 2012.

Non-Final Office Action for U.S. Appl. No. 12/411,357 dated Nov. 9, 2011.

Final Office Action for U.S. Appl. No. 12/411,357 dated Mar. 29, 2012.

Non-Final Office Action for U.S. Appl. No. 12/411,357 dated Oct. 4, 2012.

Non-Final Office Action for U.S. Appl. No. 12/786,238 dated Jul. 24, 2012.

Non-Final Office Action for U.S. Appl. No. 09/949,181 dated Mar. 18, 2002.
Non-Final office Action for U.S. Appl. No. 09/949,181 dated Jul. 24, 2002.
Final Office Action for U.S. Appl. No. 09/949,181 dated Nov. 15, 2002.
Non-Final Office Action for U.S. Appl. No. 09/949,181 dated Jan. 27, 2004.
Non-Final Office Action for U.S. Appl. No. 10/371,463 dated May 6, 2004.
Non-Final Office Action for U.S. Appl. No. 10/446,005 dated Apr. 21, 2006.
Non-Final Office Action for U.S. Appl. No. 10/051,886 dated Mar. 4, 2003.
Non-Final Office Action for U.S. Appl. No. 10/051,886 dated Oct. 20, 2003.
Final Office Action for U.S. Appl. No. 10/051,886 dated Apr. 20, 2004.
Non-Final Office Action for U.S. Appl. No. 10/051,886 dated Nov. 17, 2004.
Non-Final Office Action for U.S. Appl. No. 10/051,886 dated Aug. 23, 2005.
Final Office Action for U.S. Appl. No. 10/051,886 dated Jan. 24, 2006.
Non-Final Office Action for U.S. Appl. No. 10/051,886 dated Jun. 29, 2006.

* cited by examiner

SPUTTER DEPOSITION OF CERMET RESISTOR FILMS WITH LOW TEMPERATURE COEFFICIENT OF RESISTANCE

This application claims priority from U.S. provisional patent application Ser. No. 61/180,884, filed on May 24, 2009, entitled "Sputter deposition of cermet resistor films with low temperature coefficient of resistance", which is incorporated herein by reference.

BACKGROUND OF THE INVENTION

Sputter deposited thin-film resistors having low temperature coefficient of resistance (TCR) are required for the production of passive electronic components and various types of integrated circuits (ICs). Metal and alloy thin films such as Ta, NiCr, and CuNi are widely employed for relatively low value resistors with sheet resistance in the range of 20-200Ω/□ (ohms per square). Metal silicide films such as $WSi_x$ and $CrSi_2$ provide higher values of resistance to a few kilo-ohms per square but their TCR is too high to be employed in precision circuitry.

Cermet materials comprising solid solutions of metal particles in a ceramic (dielectric or semiconductor) matrix can exhibit electrical conduction by electron tunneling between the metal particles, and thus offer a wide range of resistances based on the amount of metal particles. The mechanism which control or alter the thermostability of cermet resistors is not completely understood. It has been observed that various semiconducting oxides exert an influence on the temperature response of resistivity of cermet resistors so as to make them more thermally stable. For example, TCR of these cermet films is also dependent on the compositions, and thus current thin film cermet resistors have resistance and TCR coupled through their compositions, with optimization for resistance can lead to a specific composition that is detrimental to TCR, and vice versa.

In general, only resistance or TCR for a cermet resistor can be optimized through composition engineering. For example, high resistances up to 20 kΩ/□ can be obtained in cermet films having a low percentage of metal particles, but these cermet films are often accompanied with high negative values of TCR, for example, TCR ranging from −1500 to 500 ppm/° C. for a range of resistance values from 0.001 to 0.1 Ω-cm. Alternatively, cermet films with low TCR (e.g., close to zero ppm/° C.) can be achieved by balancing the amount of their metal and ceramic components, but these cermet films have a certain range of resistances, typically less than few hundreds Ω/□).

Geometry approach can be used to increase film resistance, such as reducing the resistor film thickness or increasing the resistor path length. However, the geometry of the thin film resistors can have limitations, such as size constraints and fabrication problems such as stability and uniformity of the film properties.

SUMMARY OF THE DESCRIPTION

The present invention discloses methods and apparatuses for thin film resistors with optimized resistance and TCR value. In an embodiment, the present invention decouples resistance from TCR properties in a cermet thin film resistor fabrication process, so that desired values for both characteristics can be achieved. For example, desired resistance value of a cermet resistor can be achieved through composition optimization, and desired TCR value of the cermet resistor can be achieved though an anneal sequence.

In an embodiment, the present invention discloses an anneal sequence to adjust TCR of cermet thin film resistors toward near zero values. In an embodiment, the anneal sequence comprises a plurality of anneal processes sandwiching passivation processes. For example, after forming cermet thin film resistors having optimized compositions, the cermet resistors are first annealed at a high temperature for a short time, followed by a passivation at a lower temperature and a longer process time, and followed by a second anneal. Additional passivation/anneal sequence can be performed.

In an embodiment, the cermet materials are chromium-silicon compounds, such as Cr—Si—O, $CrSi_2$—Cr—SiC, and Si—SiC—$CrB_2$. The anneal process is performed in reduced pressure of non-oxidation ambient at temperature between 400-500 C for less than 5 minutes. The passivation process is performed in oxygen- and nitrogen-containing ambient at temperature less than 100 C for less than 24 hours. High resistance cermet films (e.g., >1000Ω/□) with near zero TCR (e.g., between −50 to 0 ppm/° C.) can be obtained.

DETAILED DESCRIPTION OF THE PREFERRED EMBODIMENTS

Figure 1:
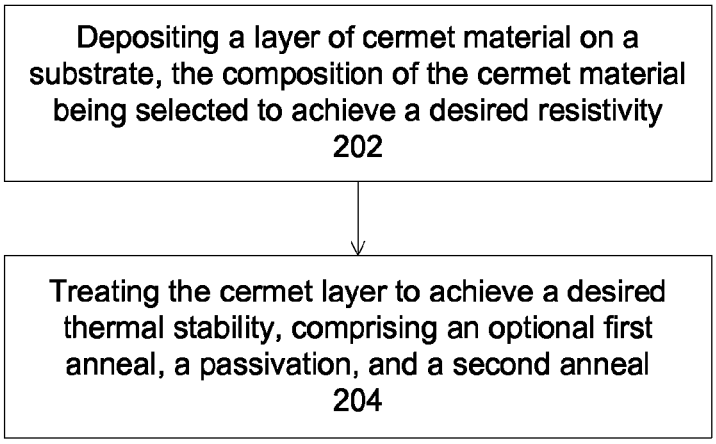
FIG. 1 shows an exemplary flowchart according to an embodiment of the present invention.

In an embodiment, the present invention discloses methods to fabricate thin film resistors with targeted resistance and TCR (temperature coefficient of resistance) values, together with thin film resistors fabricated from the methods. The method according to an embodiment of the present invention comprises a sequence of process steps that are used to adjust the resistor thin film properties to achieve thermally stable resistors with the desired values. In an embodiment, thin cermet films are deposited on substrates using a dc magnetron. During sputter deposition in the dc magnetron, the films are exposed to an elevated temperature with an applied RF bias to the substrate. After the sputter deposition in the dc magnetron, the films are exposed to an annealing sequence to produce a thermally stable thin film resistor with the targeted TCR and resistance values.

In the production of resistive films in the dc magnetron source, further optimization of the film properties can be achieved by adjusting the sputter target composition, the sputtering and reactive gas pressure, the substrate temperature during deposition, the deposition rate, and the annealing temperature to produce the desired film properties, among other parameters. However, optimizing both resistance and TCR values has been difficult to achieve through material and process parameter optimizations. For example, the resistive properties of the cermet films are dependent on the ratio of the percentage of semiconductor phase material to the percentage of metal phase material in the composite. A high percentage of metal particles in cermet films can decrease their resistance, where a low percentage of metal particles (or a high percentage of ceramic matrix) can increase their resistance.

In addition, the same ratio also affects the TCR of the films, since TCR values may be roughly controlled by varying the concentration of the metal and semiconductor phases in the cermet films. For example, a high percentage of metal particles in cermet films can lead to an increase in positive TCR. And a low percentage of metal particles can lead to an increase in negative TCR. In general, thin resistor films with low TCR (<50 ppm/° C.) can be achieved with specific compositions of metal and ceramic materials. The metal component contributes to a positive TCR and the semiconductor and dielectric components contribute to a negative TCR, and thus certain combinations of these constituents can produce resistors with TCRs close to zero ppm/° C. For example, composite silicon-chromium films containing approximately 27 atomic % Cr have been reported to have the lowest TCR of the Si—Cr types of resistors. Further reduction of the TCR to a near zero ppm/° C. level can be achieved when appropriate target mixes are used, for example, through optimization of the sputter technique and the process parameters.

Thus in general, resistance and TCR values for a cermet resistor are coupled through the compositions of metal and ceramic. Compositions and deposition conditions can be optimized to achieve near zero TCR for certain known ranges of resistances. Outside these resistance ranges, the TCR values are either more positive or negative. For example, currently sputtering processes using a target composition of 48% $CrSi_2$/27% Cr/25% SiC can be used to produce high resistance cermet resistor films with negative TCR values between −50 to −100 ppm/° C. Further reductions of TCR values for these high resistance thin cermet films have been difficult to achieve through optimization of the target composition and process parameter optimization, and have not been reported.

Advanced high-precision and high-performance analog ICs require thin-film resistors having higher resistance and simultaneously low TCR. In prior art approaches, the resistance values are increased in cermet thin film resistors by increasing the percentage of the ceramic (e.g., dielectric or semiconductor) phases of the materials in the cermet material. However, this typically results in an unacceptable shift in the TCR to negative values (e.g., the resistance increasingly decreases with increasing temperatures).

In an embodiment, the present invention discloses a fabrication of thin resistor films with high resistance and TCR values close to zero ppm/° C. In an embodiment, the present invention provides an effective sputtering and post deposition treatment methodology that enables further reduction in the TCR to near zero ppm/C while simultaneously providing high values of resistance.

In an embodiment, the present invention discloses a method for producing thin film resistors with a range of film properties in which the TCR can be varied from a negative value to a positive value. The method includes deposition processes and post-deposition treatments to produce thin films with, for example, high resistance and near zero TCR (for example, in the range of +/−10 ppm/° C.) without the need to change or adjust the sputter target composition.

In an embodiment, the present invention discloses silicon-chromium based cermet resistors and methods to fabricate silicon-chromium based cermet films for thin film resistors used in advanced high-precision and high-performance analog integrated circuits.

In an embodiment, the present invention discloses a method to fabricate a cermet resistor by decoupling the resistance from the thermal stability properties. For example, the resistance is achieved by optimizing the compositions and deposition properties, while the thermal stability is achieved by a post deposition anneal sequence. FIG. 1 illustrates an exemplary process to fabricate a thin film cermet resistor according to an embodiment of the present invention. Operation 202 deposits a layer of cermet material on a substrate with the composition of the cermet material selected to achieve a desired resistivity. In an embodiment, the cermet layer is deposited by sputtering deposition, for example, by a dc magnetron. The sputter deposition can be performed in reduced pressure (e.g., vacuum or low pressure of mTorr or less), using argon. The deposition temperature can be less than 400 C, and preferably between 250 and 350 C. An optional RF bias can be applied during the sputter deposition, for example, to improve the cermet film quality.

After deposition, operation 204 treats the deposited cermet layer to achieve a desired thermal stability with the treatment comprising an anneal sequence comprising an optional first anneal, a passivation and a second anneal. The anneal processes are performed at high temperature, such as between 400 to 450 C, and preferably higher than 300 C. The anneal processes are also performed for a short time, for example, in 5 minutes of less, and preferably between 1 to 2 minutes. The anneal processes are also performed in reduced pressure, such as in vacuum ambient. The first anneal can performed in-situ with the deposition process, for example, by performing a sequence of deposition/anneal without breaking vacuum or exposing the deposited film to atmospheric ambient. For example, the first anneal process can be performed in the same chamber as the deposition process, after completing the deposition. Alternatively, the substrate can be transferred from the deposition chamber to an anneal chamber without exposing to atmospheric ambient, for example, transferred in a cluster tool. The first anneal can be optional, for example, by embedding the anneal process with the deposition process. For example, the deposition process can be tailored so that the deposited film can undergo annealing at the same time.

The passivation process can be performed at lower temperature and longer time than the anneal processes. In an embodiment, the passivation is performed at room temperature or at any temperature less than 100 C. The passivation time can be less than 48 hours, and preferably between 3 and 24 hours. The passivation can be performed in oxygen- and/or nitrogen-containing ambient, such as atmospheric ambient. The passivation can be performed in atmospheric pressure, in reduced pressure or in pressure higher than atmospheric pressure. In an embodiment, accelerate passivation can be performed to reduce the process time, for example, to be less than 12 hours. For example, higher pressure can be used to accelerate the passivation process.

Figure 2:
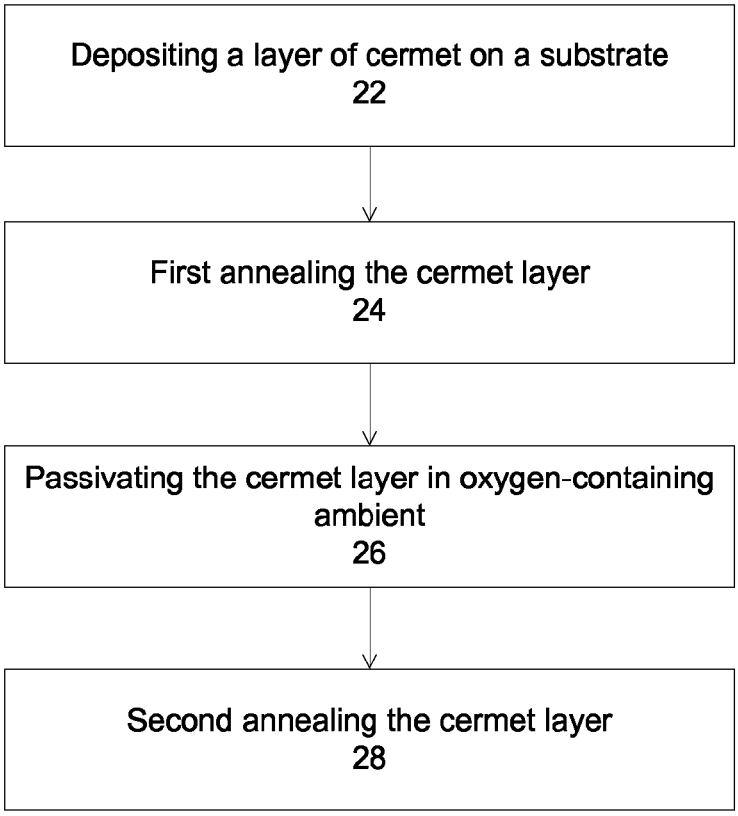
FIG. 2 shows another exemplary flowchart according to an embodiment of the present invention.

In an embodiment, the present invention discloses process conditions for film formation with desired resistance and TCR values, comprising an anneal sequence of first anneal, passivation, and second anneal. FIG. 2 illustrates an exemplary process for fabricating a thin cermet film according to an embodiment of the present invention. Operation 22 deposits a cermet layer on a substrate, for example, by a sputtering process. Operation 24 anneals the deposited cermet layer a first time, such as in vacuum for less than 2 minutes at temperature less than 450 C. Operation 26 passivates the annealed cermet layer in oxygen-containing ambient at low temperature, such as in air at room temperature and atmospheric pressure for less than 24 hours. Operation 28 annealed the passivated cermet layer for a second time. The conditions for the anneal and the passivation processes can vary from the above described conditions, in order to achieve a thermal stable thin cermet layer, characterized by minimum changes in resistance as function of time or temperature.

Figure 3:
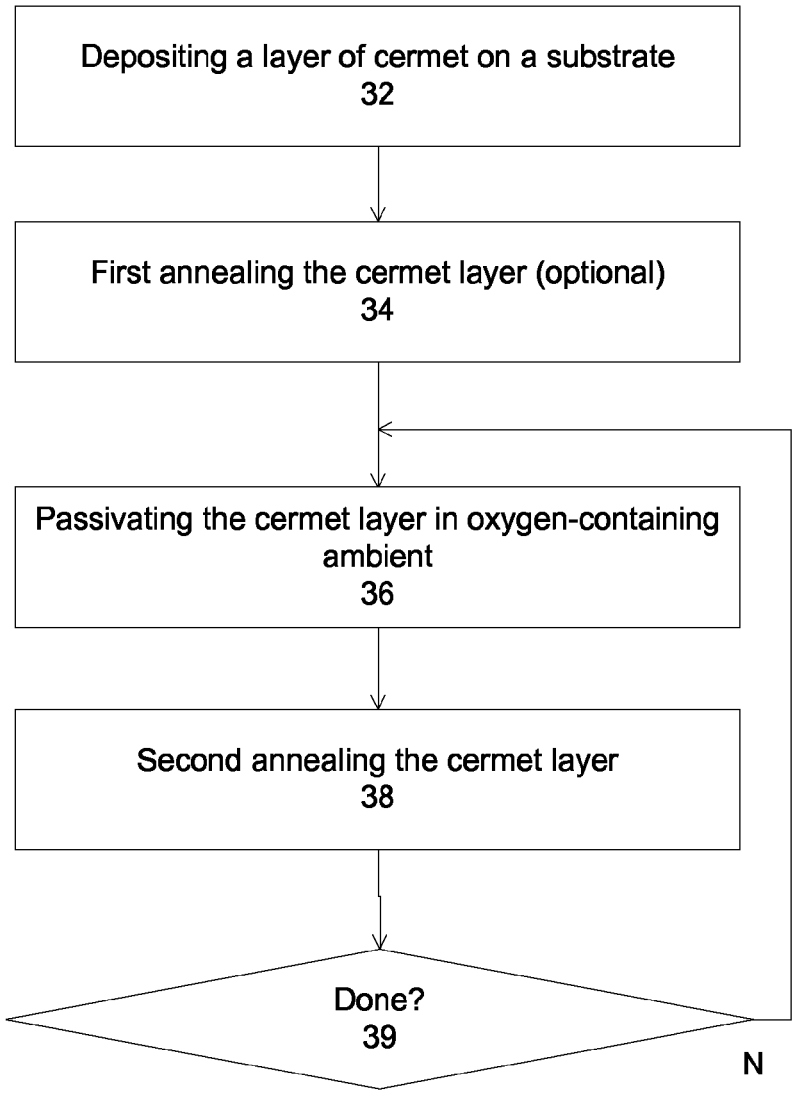
FIG. 3 shows another exemplary flowchart according to an embodiment of the present invention.

In an embodiment, the anneal sequence is repeated until reaching a desired thermal stability. Alternatively, the anneal sequence can be repeated to reduce the passivation time. FIG. 3 illustrates a repeated sequence of a cermet layer according to an embodiment of the present invention. After depositing a layer of cermet on a substrate (operation 32) with an optional first anneal process (operation 34), the cermet layer is then passivated (operation 36) and annealed a second time (operation 38). The passivation and second anneal is repeated (operation 39) until the process is completed, for example, by reaching a desired thermal stability or by saturating the anneal sequence. In an embodiment, the present invention discloses process conditions for film formation with high resistance and low TCR.

In an embodiment, the present invention discloses a method containing a sequence of process steps that are used to adjust the resistor film properties to achieve thermally stable thin film resistors with targeted resistance and TCR values. In an embodiment, the resistor film comprises cermet materials comprising metal particles embedded in a ceramic matrix, such as dielectric or semiconductor matrix. In an embodiment, the cermet materials comprise chromium-silicon compounds, such as Cr—Si—O, $CrSi_2$—Cr—SiC, and Si—SiC—$CrB_2$. In an embodiment, cermet resistors are based on mixture of oxide, boride, or carbide materials. Generally, the metallic elements used are chromium, nickel, molybdenum, and cobalt.

In an embodiment, thin films are deposited on thermally oxidized silicon wafers using a dc magnetron. During sputter deposition in the dc magnetron, the films are exposed to an elevated temperature, such as less than 450° C., or between 250 to 350° C., with an applied RF bias to the substrate. Prior to the sputter deposition, a degas step or a pre-heat step can be utilized to improve film properties and to improve the repeatability of the process, among other potential benefits. After the sputter deposition in the dc magnetron, the films are exposed to an annealing sequence to produce a thermally stable thin film resistor with the targeted TCR and resistance values.

Figure 4:
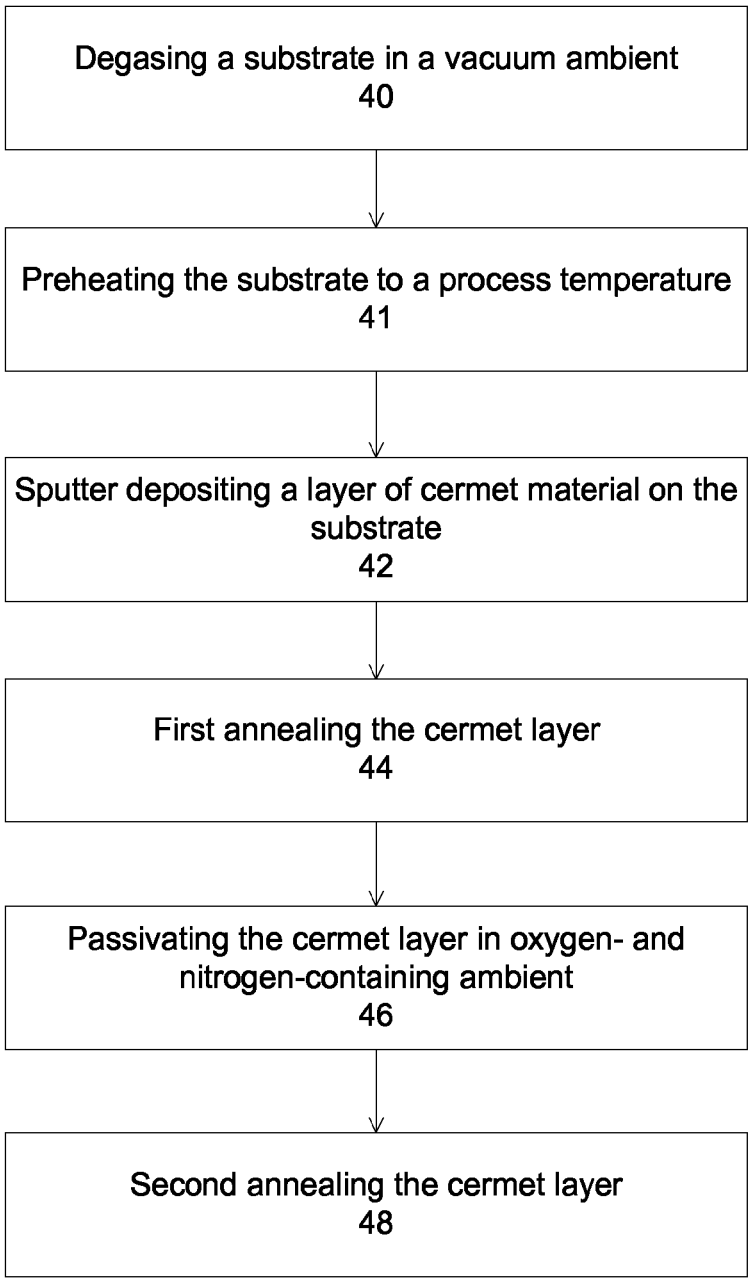
FIG. 4 shows another exemplary flowchart according to an embodiment of the present invention.

FIG. 4 illustrates an exemplary process of fabricating a thin resistor film according to an embodiment of the present invention. The illustrated process comprises an optimized dc sputter process consisting of a substrate degas step, a sputter deposition step at a temperature 350° C., a dc power level of 300 W, an rf bias power of 50 W, and a double anneal in vacuum at a temperature of 450° C. with an intermediate exposure to atmosphere for preferably 3-24 hours, produces 2.5-4 nm thick $CrSi_2$—Cr—SiC cermet films with resistances ranging from 1800 to 1200Ω/□ and TCRs from −50 to ~0 ppm/° C., respectively.

The exemplary process comprises an optional degas step 40, an optional preheat step 41, a sputter deposition step 42, a first anneal step 44, a passivation step 46, and a second anneal step 48.

Degas step 40 is commonly implemented prior to a sputter deposition process to remove water vapor, hydrocarbons, and other contaminants from the surface of a wafer that might otherwise have a detrimental effect on the quality of the sputtered film. The degas process typically consists of an exposure to high intensity lamps that provide exposure to heat and light in a vacuum environment that cause the contaminants to desorb from the wafer surface. Rf power applied to the substrate in a plasma environment can also be used to produce a clean surface prior to sputter deposition step 42. Degas process step 40 can be performed in the same chamber within which the sputter process is performed or can be performed in another module or location on the sputter system.

Preheat step 41 is commonly employed to raise the temperature of the wafer for sputter processes that require a substrate to be at elevated temperatures during a subsequent sputter deposition step 42. This step can be performed within the same position in which the sputter deposition step is to be performed or elsewhere on the sputter system. The sequence of degas and preheat steps can be in any order (e.g., degas before preheat or preheat before degas) or can be combined together in a single step (e.g., an exposure to high temperature in vacuum ambient that both degas and preheat the substrate at the same time).

In an embodiment, the thin films are deposited with an applied rf substrate bias during deposition in the dc magnetron to achieve low TCR values. The rf bias power is typically less than 100 W, and preferably between 30 and 70 W. Films deposited with rf substrate bias generally have lower sheet resistance and higher thermal stability compared to films that are deposited without substrate bias.

After sputter deposition, the thin films are exposed to a first anneal 44 in vacuum at high temperature, preferably between 400-450° C. for approximately 1-2 minutes. This anneal is preferably done before exposure of the substrate to ambient conditions and preferably immediately following the sputter deposition, either in the same chamber that was used to deposit the film, or in a second chamber, load lock, or annealing location contained within a clustered arrangement of process and transport modules. In an embodiment, the anneal process is performed in non-oxygen ambient and at reduced pressure.

After deposition and after the first annealing step, the thin films are then exposed to a passivation process 48, for example, at atmospheric conditions, preferably for 1 to 48 hours and more preferably from 3 to 24 hours.

After the deposition, the first annealing step, and the exposure of the substrate to atmosphere, the thin films are exposed to a second annealing step 48 at high temperature, preferably in vacuum, and preferably between 400-450° C., for 1-2 minutes.

The anneal treatment can change the crystal structure of the deposited thin films, with the adsorbed foreign elements removed, thus stabilizing the cermet film structure. Anneal in non-oxidation ambient can decrease the resistivity of the cermet film using high temperature. Anneal in oxygen ambient can increase the resistivity of the cermet film due to oxidation, such as oxidization of the metal film elements. However, with low temperature passivation in oxygen ambient, the oxidation effect can be small.

Figure 5:
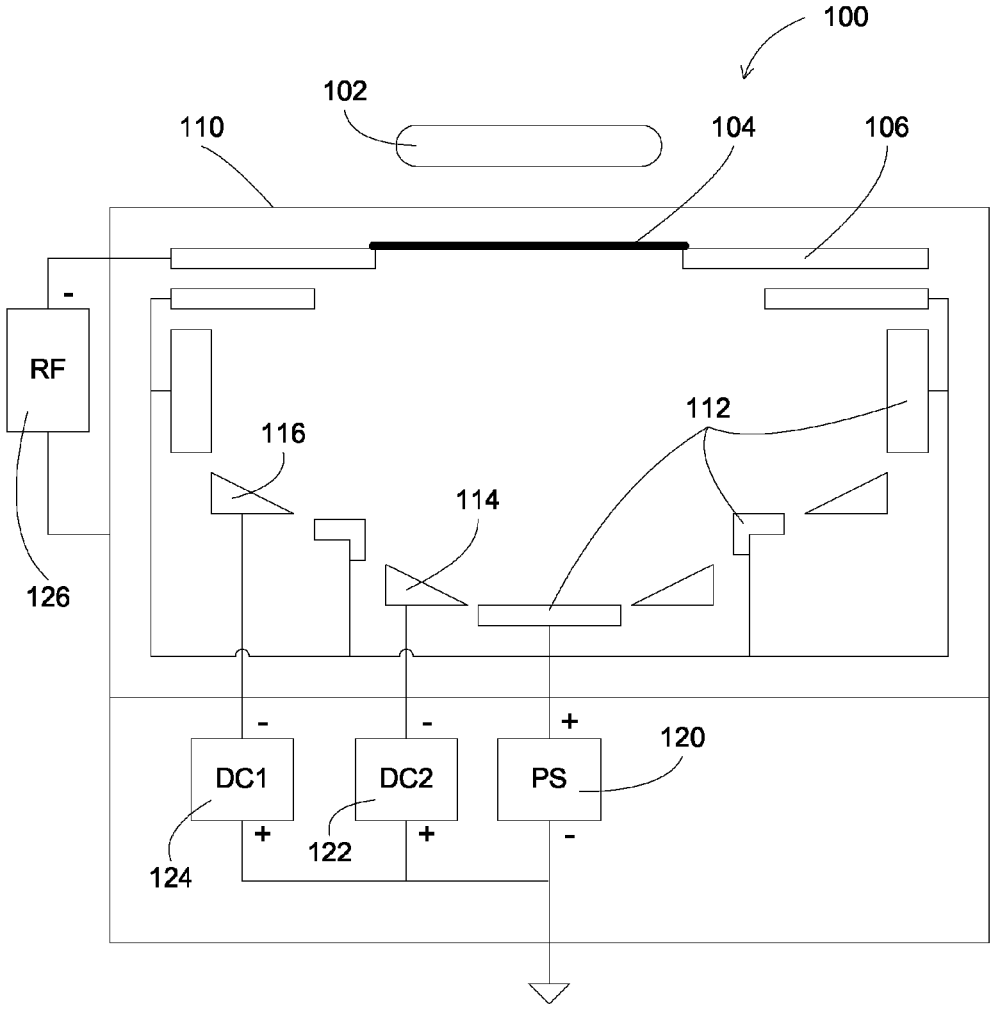
FIG. 5 shows a cross section of an exemplary dc magnetron.
Figure 6:
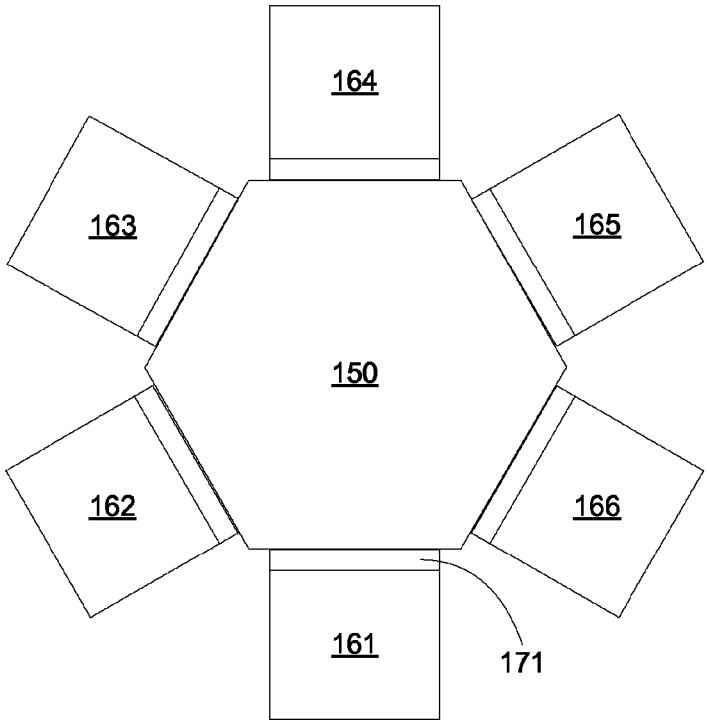
FIG. 6 shows an exemplary cluster tool with positions for degas, preheat, and sputter deposition.

In an embodiment, the sputter deposition process 42 can be performed in a sputter deposition module such as the S-Gun magnetron 100 shown in FIG. 5. The S-Gun has two independently controlled conical targets 114, 116 mounted concentrically with a central anode 112. Each target 114, 116 is powered by a dc power supply 122, 124. Power distribution between the inner and the outer targets enables deposition of highly uniform films onto stationary substrates. An additional rf power 126 (typically, in the range of 30-300 W) may be applied to the wafer holder 106, igniting an rf plasma discharge in the wafer vicinity, which generates a negative self-bias potential on the substrate thus creating low energy ion bombardment during the film growth. Before, during, and/or after deposition, the substrate may be heated to temperatures of up to 500° C. by infrared radiant heater 102 in the S-Gun process module. Sputter gas (typically argon or a mixture of argon and a reactive gas such as oxygen or nitrogen, if required) is introduced through the gas distribution channels in the central anode. Base vacuum in the process module pumped by turbomolecular pumps and cryopumps is typically in the range of $1\times10^{-8}$ to $5\times10^{-7}$ Torr.

In the preferred embodiment for thin $CrSi_2$—Cr—SiC resistor films (hereafter referred to as $Si_xCr_y$ films) the phase composition of the sputtering targets is 48% $CrSi_2$/27% Cr/25% SiC by weight. In this embodiment, degas step 40 consists of a substrate heating step in the range of 300-500° C. in vacuum for typical times of between 30 to 120 seconds, and preferably at 450° C. for 60 seconds. Following degas step 40, an optional preheat step 41 is performed in the preferred embodiment in the same module as subsequent sputter deposition step 42. Preheat step 41 is typically implemented to raise the temperature of the wafer so that the temperature of the substrate prior to starting the plasma discharge to enable sputter deposition step 42 is in the range of 300-400° C. and preferably at 350° C. Upon reaching the targeted temperature for deposition, the power is applied to the sputter targets to initiate the discharge and proceed with the sputter deposition onto the substrate.

In an embodiment, the substrate is biased by applying a power source to the substrate or to the substrate support to provide ion bombardment during the deposition process step 42.

Following sputter deposition step 42 is the first anneal 43. In an embodiment, the first anneal is done under vacuum immediately following sputter deposition step 42. The anneal step can be done in the same module as the sputter deposition step or in a separate module or position within the cluster module 150. During the anneal process 43, the temperature of the wafer reaches 400-500° C. for 1-5 minutes and preferably 450° C. for 1-2 minutes.

After the first anneal step 43, the substrate is exposed to passivation step 44 consisting of an exposure to an environment containing oxygen and nitrogen as a precursor to final anneal step 45, to produce resistive properties in the thin sputter deposited cermet films that are thermally stable. One such passivation process 44 is an exposure to air at ambient atmospheric conditions for 3-48 hours and preferably for 24 hours. Other embodiments include exposure to air within a module on the vacuum chamber or exposure to oxygen, nitrogen, a gas mixture of nitrogen and oxygen, or a gas mixture that contains oxygen and nitrogen and other gases, the net result of which produces the same effective stabilization of the resistive film properties as is produced upon exposure to air at atmospheric conditions. In an embodiment, other oxygen containing gases such as $NO_2$, NO, CO, $CO_2$, ozone, $H_2O$ vapor, and others, can be added. Similarly, inert gases such as argon, helium, neon, xenon, or other inert gases, can also be added. Further, other gases that do not deleteriously affect the process of producing thermally stable resistive films can be added to the gas mixture.

A second anneal step 45 follows passivation 44. In an embodiment, second anneal 45 is performed under vacuum. The second anneal step 45 can be done on the same module as the sputter deposition step, in a separate module or position within the cluster module 150 on which sputter deposition step 42 was accomplished, a module not connected to the system used for prior steps, or any other system or combination of systems that are necessary to raise the temperature of the substrate to the required anneal temperature to produce thermal stability of the resistive properties of the sputter deposited films. During the anneal process 43, typical substrate temperatures are in the range of 400-500° C. for 1-5 minutes and preferably 450° C. for 1-2 minutes. The actual anneal temperature can vary depending on factors such as the starting film composition and ultimate target for the TCR. Changes to the anneal temperature and anneal time can be made that produce the same result of thermally stable resistive film properties using the inventive process sequence and would remain within the spirit of the invention. Additionally, the second anneal step could be split into multiple steps to produce similar results of thermally stable resistive film properties from sputter deposited $Si_xCr_y$ films.

Figure 7:
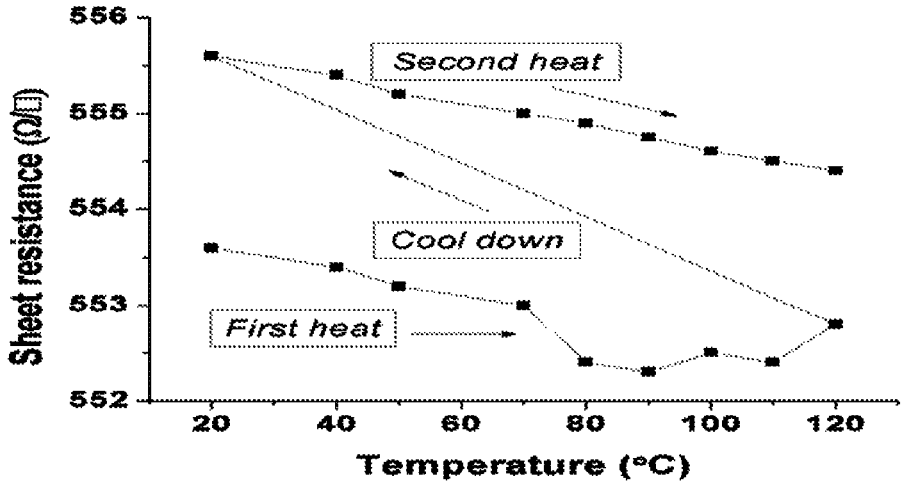
FIG. 7 shows the changes that can occur in sheet resistivity as $Si_xCr_y$ films deposited at room temperature are cycled from 20° C. to 120° C. to 20° C. without post-deposition treatment.

Control $Si_xCr_y$ films deposited at ambient temperature using sputter deposition step 42 (without the present anneal sequence) results in non-uniform sheet resistance across the substrate upon which the sputtered films are deposited. The resistance of these sputtered films will gradually increase upon exposure to air at ambient conditions and these sputter deposited films have been found to exhibit changes in resistance when cycled through temperatures in the range of 20 to 120° C. Observations of irreversible variation in the measured resistances, as shown in FIG. 7, indicates that deposited films are not thermally stable. The resistive properties of the films change when exposed to temperatures above ambient room temperature (20-30° C.) and that these changes in resistive properties do not return to the original state when the temperatures are returned to ambient. FIG. 7 shows that for an initial sheet resistance of 553.5 ohms/□, an increase to a sheet resistance of 555.5 ohms/□ is observed after cycling the wafer from 20 C to 120° C. and then back to 20° C.

Figure 8:
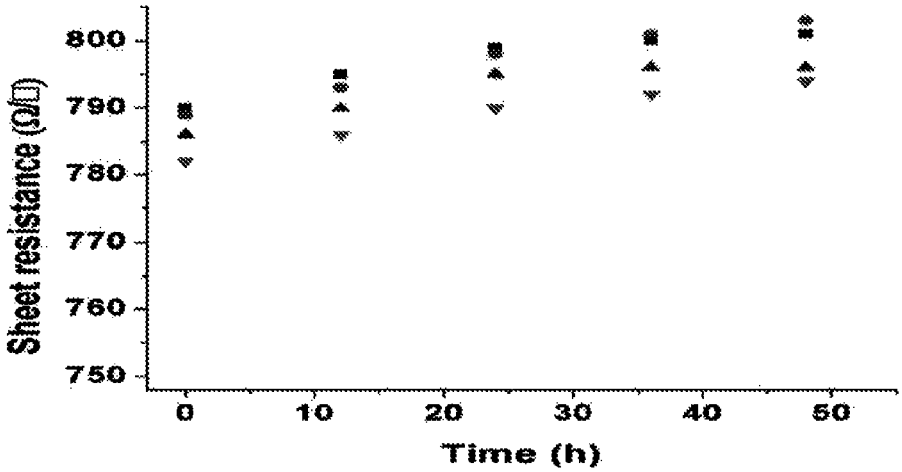
FIG. 8 shows the variation in sheet resistance versus the exposure time to air at ambient conditions for 7 nm thick SiCr films sputter deposited without post-deposition annealing in vacuum

FIG. 8 shows the time dependent resistance of the sputter deposited films upon atmospheric ambient exposure, which illustrates the lack of thermal stability of the sputter depositing $Si_xCr_y$ films without the present anneal sequence. In FIG. 8, the sheet resistance is shown to increase over time for $Si_xCr_y$ films deposited at 350° C. for durations up to 50 hours. These data show that deposition at 350° C. is not sufficient to produce $Si_xCr_y$ films with thermally stable film properties. The average sheet resistance for the films used to collect the data shown in FIG. 8 was found to be approximately the same as the films deposited at ambient temperature but the standard deviation for these films deposited at 350° C. was found to be favorably reduced from ~3% to ~1%. The non-uniformity of the film sheet resistance across the wafer for these tests was measured with an automatic four-point probe.

The inventive process provides a method for producing thermal stability in the resistive properties of the $Si_xCr_y$ films and reducing or eliminating the variation in film properties observed upon temperature cycling of the thin $Si_xCr_y$ films.

Figure 9:
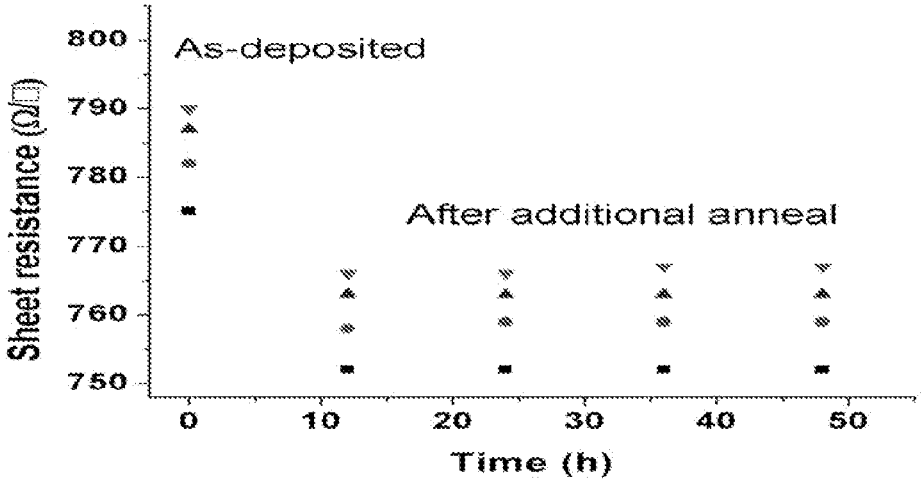
FIG. 9 shows the variation in sheet resistance versus the exposure time to air at ambient conditions for 7 nm thick $Si_xCr_y$ films sputter deposited with post-deposition annealing in vacuum

FIG. 9 shows the time dependent resistance of the deposited cermet films including the post deposition treatments upon atmospheric ambient exposure, which shows the thermally stable $Si_xCr_y$ films. The $Si_xCr_y$ films were fabricated as follows:

i) Degas step 40: 450° C. anneal for 60 sec in separate degas module ii) Preheat step 41: raised temperature to 350° C. in sputter module without plasma iii) Sputter deposition step 42: temperature=350° C., cathode dc power=300 W, rf bias power=50 W iv) First anneal step 43: 450° C. for 60 sec in vacuum (in situ)

v) Passivation step 44: exposure to ambient for 24 hours vi) Second anneal step 45: 450° C. for 120 sec in vacuum The sheet resistance measurements from films that were fabricated with and without the post deposition steps 43, 44, and 45 show that the resistive film properties remain stable for the 50 hour duration of the testing. The sheet resistance values for the as-deposited films are shown for comparison. The addition of post deposition annealing steps 43, 44, and 45 in the preferred embodiment ensures stabilization of the film resistance which did not change during further storage.

FIG. 9 illustrates an improvement of deposited films after treated with an anneal sequence. The observed changes in sheet resistance between the as-deposited films and the films after post deposition steps 43, 44, and 45 were found to vary with film thickness, but all films exhibited improved thermally stable resistive film properties. It is believed that further optimizations can bring additional improvements to the thermal stability properties.

Figure 10:
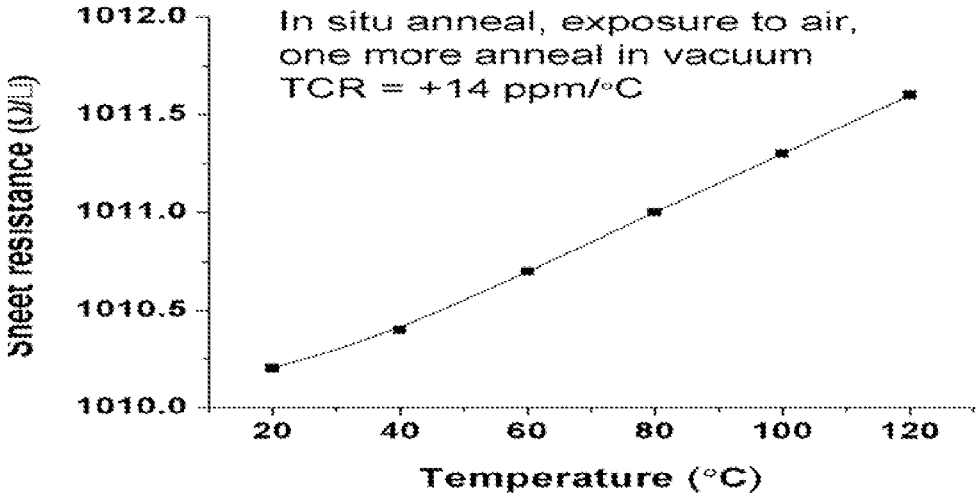
FIG. 10 shows the variation in sheet resistance for a sputter deposited $Si_xCr_y$ film versus the temperature during resistance measurement showing the low positive value of TCR that can be achieved using the inventive technique.

In addition to thermal stability, thin films with low TCR values can be produced using the present anneal sequence. Metal contacts were deposited over the sputter deposited $Si_xCr_y$ films to produce structures for determining the film resistance. The TCR was determined by taking measurements of the resistance using a multimeter at various substrate temperatures from 20° C. to 120° C. The TCR value was calculated using a well-known formula: $TCR=10^6\times(R-R_0)/[R_0\times(T-T_0)]$, ppm/° C. where $T_0$=20° C., $R_0$ is the resistance measured at 20° C., T is 120° C., and R is the resistance at 120° C. FIG. 10 illustrates the resistance measured as a function of temperatures where TCR is calculated to be 14 ppm/° C.

In addition to the production of thermally stable films, optimization of post deposition steps 43, 44, and 45, in combination with steps 40, 41, and 42, can be used to produce resistive $Si_xCr_y$ films with TCR properties over a wide range. Of particular interest for industrial applications are resistive films with low TCR values of less than +/−50 ppm/° C. Thin film resistors fabricated with the present anneal sequence can be used to produce films that have both thermally stable resistance characteristics and that have low TCR values.

While various embodiments of the present invention have been described in detail, it is apparent that modifications and adaptations of those embodiments will occur to those skilled in the art. However, it is to be expressly understood that such modifications and adaptations are within the spirit and scope of the present invention. For example, the resistors or the method of forming the resistors by this invention are not limited to a reactive sputtering method, but other conventional methods such as chemical vapor deposition (CVD) method, a reactive evaporation method utilizing an electron beam and a plasma ion reactive sputtering method are also applicable. The resistor materials are not limited to cermet materials, but can be applicable for other resistive materials. The method by this invention is not limited to ICs but applicable to other discrete resistors such as a resistor network formed on a ceramic substrate and a discrete film resistor for hybrid circuits.

What is claimed is:

1. A method for forming a thin film resistor, comprising:

depositing a layer of cermet material on a substrate, the composition of the cermet material optimized to achieve a desired resistivity;

treating the cermet layer to achieve a desired thermal stability while maintaining the desired resistivity, the treatment comprising an anneal sequence of a plurality of anneal sandwiching a passivation process of lower temperature and longer time, wherein the anneal is performed in a non oxidation ambient, wherein the passivation process comprises an exposure to an oxidation ambient.

2. A method as in claim 1 wherein depositing the cermet material is performed by sputtering with a substrate bias at temperature below 400 C.

3. A method as in claim 1 wherein the anneal sequence comprises a first anneal and a second anneal sandwiching a passivation process.

4. A method as in claim 3 wherein the anneal sequence further comprises a second passivation process followed by a third anneal.

5. A method as in claim 1 wherein the anneal is performed in vacuum.

6. A method as in claim 1 wherein the first anneal is performed during the deposition.

7. A method as in claim 1 wherein the first anneal is performed at temperature below 450 C and less than 2 minutes.

8. A method as in claim 1 wherein the passivation process is performed in air ambient at atmospheric pressure and room temperature in less than 24 hours.

9. A method for forming a thin film resistor, comprising:

sputtering a layer of cermet material on a substrate;

performing an anneal sequence on the cermet layer, the anneal sequence comprising at least a first anneal, a passivation, and a second anneal, wherein the passivation comprises lower temperature and longer time than the anneals, wherein the anneal is performed in a non oxidation ambient, wherein the passivation comprises an exposure to an oxidation ambient.

10. A method as in claim 9 wherein the cermet material comprises at least one of $CrSi_2$—Cr—Sic, Cr—Si-0, and Si—Sic-$CrB_2$ compounds.

11. A method as in claim 9 wherein the anneal sequence further comprises a second passivation process followed by a third anneal.

12. A method as in claim 9 wherein at least one of the anneals is performed in reduced pressure at temperature below 450 C and less than 5 minutes.

13. A method as in claim 9 wherein at least one of the anneals is performed in non-oxygen-containing ambient.

14. A method as in claim 9 wherein the passivation process is performed in air ambient at atmospheric pressure and room temperature in less than 24 hours.

15. A method as in claim 9 wherein the passivation process is performed in reduced pressure having oxygen and nitrogen containing ambient.

16. A method for forming a thin film resistor, comprising:

sputtering a layer of cermet material on a substrate;

performing an anneal sequence on the cermet layer, the anneal sequence comprising at least a first anneal, a passivation process, and a second anneal, wherein the anneal is performed in a non oxidation ambient at temperature between 400 and 500 C for between 1 and 5 minutes, wherein the passivation comprises an exposure to an oxidation ambient at a temperature less than 100 C for between 1 and 48 hours.

17. A method as in claim 16 wherein the cermet material comprises at least one of $CrSi_2$—Cr—Sic, Cr—Si-0, and Si—Sic-$CrB_2$ compounds.

18. A method as in claim 16 wherein the first or second anneal is performed in vacuum.

19. A method as in claim 16 wherein the passivation process is performed in air ambient at atmospheric pressure.

20. A method as in claim 16 wherein the anneal sequence further comprises a second passivation process followed by a third anneal.

* * * * *